US005516069A

United States Patent [19]

Hanna

[11] Patent Number: 5,516,069

[45] Date of Patent: May 14, 1996

[54] ADJUSTABLE CONSTRUCTION SUPPORT APPARATUS

[76] Inventor: Maxwell H. Hanna, 15714 SE. 178th Pl., Renton, Wash. 98058

[21] Appl. No.: 306,617

[22] Filed: Sep. 15, 1994

[51] Int. Cl.[6] ..... E04G 25/00

[52] U.S. Cl. ..... 248/354.3; 248/354.1; 248/357; 254/101

[58] Field of Search ..... 248/354.3, 405, 248/354.1, 357, 910; 254/101, 98

[56] References Cited

U.S. PATENT DOCUMENTS

| | | | |
|---|---|---|---|
| 2,535,956 | 12/1950 | Roggensack | 248/354.3 |
| 2,570,282 | 10/1951 | Speck et al. | 254/100 |
| 3,667,730 | 6/1972 | Kollmar | 254/98 |
| 3,713,259 | 1/1973 | Tkach | 248/354.3 |
| 3,737,134 | 6/1973 | Foon | 248/354.3 |
| 4,404,780 | 9/1983 | Josephson | 254/98 |
| 4,581,863 | 4/1986 | Thaler | 248/354.3 |
| 4,826,122 | 5/1989 | Cupp | 248/237 |
| 5,000,620 | 3/1991 | Bonnema et al. | 405/221 |
| 5,058,358 | 10/1991 | Stratton | 52/702 |
| 5,118,060 | 6/1992 | Spronken | 248/218.4 |
| 5,217,325 | 6/1993 | Freeman, III | 405/229 |

FOREIGN PATENT DOCUMENTS

| | | | |
|---|---|---|---|
| 2362073 | 4/1978 | France | 254/100 |
| 639129 | 6/1950 | United Kingdom | 254/100 |

*Primary Examiner*—Karen J. Chotkowski
*Assistant Examiner*—Anita M. King

[57] ABSTRACT

An adjustable construction support apparatus includes a poured concrete footing assembly and a tube assembly retained in the footing assembly. A threaded collar is attached to a top portion of the tube assembly. A threaded shaft has complimentary threads to the threaded collar, and the threaded shaft is received by the threaded collar such that a lower portion of the threaded shaft extends into the tube assembly. A nut is welded to the threaded shaft and is adapted for receiving a wrench for applying a torque for rotating the threaded shaft. A swivel assembly is connected to an upper portion of the threaded shaft, and a bracket assembly is attached to the swivel assembly. The bracket assembly is adapted to engage a portion of a structure. The tube assembly includes a disparate diameter region adapted to receive a portion of the footing assembly such that the tube assembly is secured in the footing assembly and is prevented from moving vertically in the footing assembly. The swivel assembly includes a circular flange attached to the threaded shaft and includes a circular groove in the bracket assembly. The circular groove receives the circular flange permitting a swivel action between the circular groove on the bracket and the circular flange on the threaded shaft as the threaded shaft is rotated. The bracket assembly includes a U-shaped portion adapted to engage a complementary portion on the structure. The threaded collar is welded onto the tube assembly.

3 Claims, 3 Drawing Sheets

ADJUSTABLE CONSTRUCTION SUPPORT APPARATUS

BACKGROUND OF THE INVENTION

1. Field of the Invention

The present invention relates generally to supports for constructed decks, stairs, buildings, and the like and, more particularly, to a construction support especially adapted to be vertically adjustable.

2. Description of the Prior Art

The ground upon which constructed objects are built often settles over time. More specifically, different portions of the supporting ground may settle at different rates. As a result, the constructed object may partially sink or buckle. For example, due to settling, over the years a deck may separate from an adjacent house. In addition, stairs may separate from an adjacent deck or adjacent house.

Conventionally, to compensate for ground settling, support posts may be cut and replaced. Alternatively, the structure is jacked up above the support, and shims are placed between the structure and the support. Because of the severe inconvenience and great expense, it would be desirable to be able to adjust the height of a support for a structure without cutting a support post and without jacking up a structure and employing shims.

Poured concrete footings are commonly used components in support for structures. In this respect, it would be desirable if an adjustable height structure support worked in conjunction with poured concrete footings.

Conventional methods of compensating for ground settling, which involve cutting and jacking, often require the services of professional construction personnel for extended periods of time. As a result, such compensation methods may be quite expensive. In this respect, it would be desirable if an adjustable construction support apparatus were provided which can be readily adjusted by a homeowner.

Throughout the years, a number of innovations have been developed relating to supporting structures, and the following U.S. patents are representative of some of those innovations: U.S. Pat. Nos. 4,826,122; 5,000,620; 5,058,358; 5,118,060; and 5,217,325. More specifically, U.S. Pat. No. 4,826,122 discloses a pivoting adjustable support for a pitched roof scaffolding post. Because of torque forces involved with pivoting support structures, it would be desirable if an adjustable support were provided which did not use a pivoting support.

U.S. Pat. No. 5,000,620 discloses an adjustable pier system for supporting structures. Vertical adjustments are achieved by spaced apart holes and rods placed through those holes. The presence of adjustment holes spaced apart at predetermined intervals provides for incremental adjustments. However, needed adjustments may be greater than or less than predetermined increments. In this respect, it would be desirable if an adjustable height support provided for continuously adjustable height.

U.S. Pat. No. 5,058,358 discloses a hanger bracket for supporting a deck, wherein the hanger bracket is not adjustable once it is installed.

U.S. Pat. No. 5,118,060 discloses an adjustable bracket for building construction which includes two adjustable pivot pins. To avoid torques developed around pivot pins, as stated above, it would be desirable if an adjustable height support were provided for a structure which did not use adjustable pivots.

U.S. Pat. No. 5,217,325 discloses a system for underpinning a building which employs components driven into bedrock and employs other components that are put into position for making adjustments, that are removed after adjustments are made, and that are put back into position to make further adjustments. For convenience and simplicity, it would be desirable if an adjustable height support were provided for a structure wherein the support were always in position and readily adjustable without requiring installation of additional components.

Still other features would be desirable in an adjustable construction support apparatus. For example, when a height adjustment is made for a structure support, the height adjustment may be needed to provide added height or, alternatively, to provide reduced height. When added height is needed, additional push down pressure is exerted on footing. However, when reduced height is needed, a pulling up force is exerted on the footing. When such is the case, there is a tendency of an adjustable support to be pulled out of the footing. In this respect, it would be desirable for an adjustable support to provide features to preclude the support to be pulled out of a footing when a reduced height adjustment is made.

Thus, while the foregoing body of prior art indicates it to be well known to use adjustable height supports for structures, the prior art described above does not teach or suggest an adjustable construction support apparatus which has the following combination of desirable features: (1) enables adjustment of the height of a support for a structure without cutting a support post and without jacking up a structure and employing shims; (2) is usable in conjunction with poured concrete footings; (3) can be readily adjusted by a homeowner; (4) does not use a pivoting support; (5) provides for continuously adjustable height; (6) is in position for adjustment and is readily adjustable without requiting installation of additional components; and (7) prevents a support from being pulled out of a footing when a reduced height adjustment is made. The foregoing desired characteristics are provided by the unique adjustable construction support apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an adjustable construction support apparatus which includes a footing assembly, a height adjustment assembly connected to the footing assembly, and a bracket assembly attached to height adjustment assembly. The bracket assembly adapted to engage a portion of a structure.

In accordance with one embodiment of the invention, the height adjustment assembly includes a tube assembly retained in the footing assembly. A threaded collar is attached to a top portion of the tube assembly. A threaded shaft has complimentary threads to the threaded collar, and the threaded shaft is received by the threaded collar such that a lower portion of the threaded shaft extends into the tube assembly. A torque-receiving member, e.g. a nut, is attached to the threaded shaft and is adapted for receiving an applied torque for rotating the threaded shaft. The torque may be applied by using a wrench that engages the nut. A swivel assembly is connected to an upper portion of the threaded shaft, and a bracket assembly is attached to the swivel assembly. The bracket assembly is adapted to engage a portion of a structure.

The tube assembly includes a disparate diameter region adapted to receive a portion of the footing assembly such that the tube assembly is secured in the footing assembly.

The swivel assembly includes a circular flange attached to the threaded shaft and includes a circular groove in the bracket assembly. The circular groove receives the circular flange permitting a swivel action between the circular groove on the bracket and the circular flange on the threaded shaft as the threaded shaft is rotated. The bracket assembly includes a U-shaped portion adapted to engage a complementary portion on the structure.

The footing assembly can be comprised of concrete. The torque-receiving member is a nut welded onto the threaded shaft. The threaded collar is welded onto the tube assembly.

In accordance with another embodiment of the invention, the height adjustment assembly includes a rod portion retained in the footing assembly. A threaded shaft is attached to a top portion of the rod portion. A threaded cylinder has complimentary threads to the threaded shaft, and the threaded shaft is received by the threaded cylinder such that an upper portion of the threaded shaft extends into the threaded cylinder. A torque-receiving member is attached to the threaded cylinder and is adapted for receiving an applied torque for rotating the threaded shaft. A swivel assembly is connected to an upper portion of the threaded cylinder, and a bracket assembly is attached to the swivel assembly. The bracket assembly is adapted to engage a portion of a structure.

In accordance with another aspect of the present invention, an adjustable construction support apparatus is provide for placement between a footing assembly and a structure. The adjustable construction support apparatus includes a height adjustment assembly adapted for connection to the footing assembly, and a bracket assembly is attached to the height adjustment assembly. The bracket assembly is adapted to engage a portion of the structure.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable construction support apparatus which has all of the advantages of the prior art and none of the disadvantages.

It is another object of the present invention to provide a new and improved adjustable construction support apparatus which may be easily and efficiently manufactured and marketed.

It is a further object of the present invention to provide a new and improved adjustable construction support apparatus which is of durable and reliable construction.

An even further object of the present invention is to provide a new and improved adjustable construction support apparatus which is susceptible of a low cost of manufacture with regard to both materials and labor, and which accordingly is then susceptible of low prices of sale to the consuming public, thereby making such adjustable construction support apparatus available to the buying public.

Still yet a further object of the present invention is to provide a new and improved adjustable construction support apparatus which enables adjustment of the height of a support for a structure without cutting a support post and without jacking up a structure and employing shims.

Still another object of the present invention is to provide a new and improved adjustable construction support apparatus that is usable in conjunction with poured concrete footings.

Yet another object of the present invention is to provide a new and improved adjustable construction support apparatus which can be readily adjusted by a homeowner.

Even another object of the present invention is to provide a new and improved adjustable construction support apparatus that does not use a pivoting support.

Still a further object of the present invention is to provide a new and improved adjustable construction support apparatus which provides for continuously adjustable height.

Yet another object of the present invention is to provide a new and improved adjustable construction support apparatus that is in position for adjustment and is readily adjustable without requiring installation of additional components.

Still another object of the present invention is to provide a new and improved adjustable construction support apparatus which prevents a support from being pulled out of a footing when a reduced height adjustment is made.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
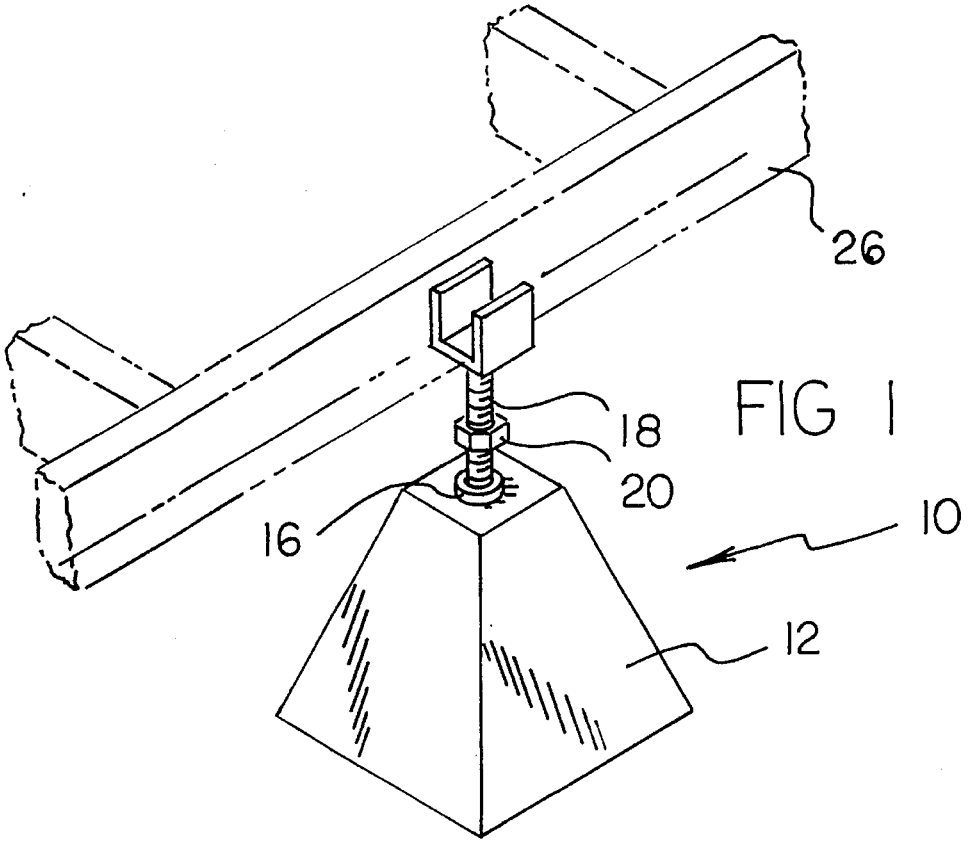
FIG. 1 is a perspective view showing a preferred embodiment of the adjustable construction support apparatus of the invention in use supporting a structure.
Figure 2:
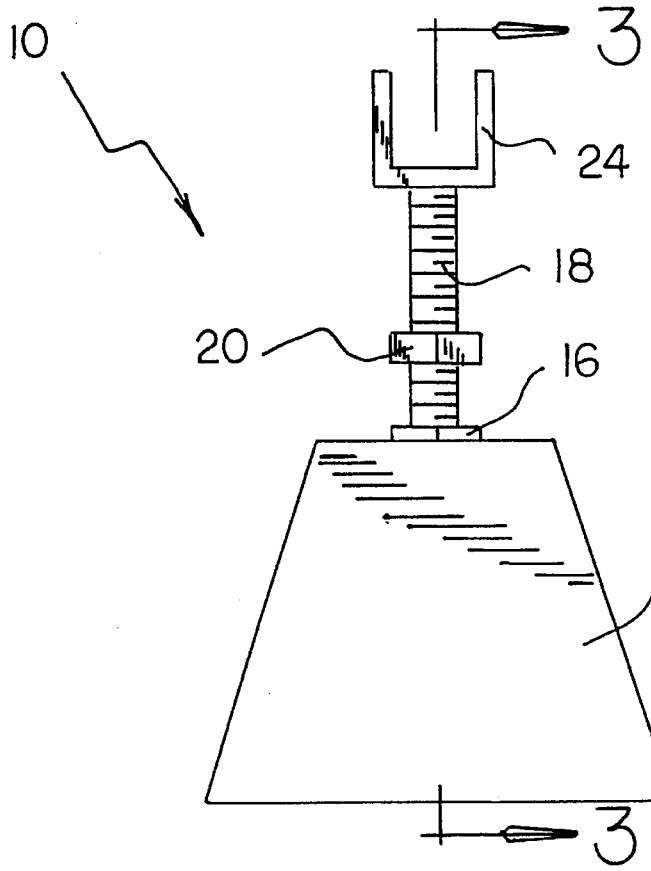
FIG. 2 an enlarged side view of the embodiment of the adjustable construction support apparatus shown in FIG. 1.

With reference to the drawings, a new and improved adjustable construction support apparatus embodying the principles and concepts of the present invention will be described.

Turning to FIGS. 1–4, there is shown an exemplary embodiment of the adjustable construction support apparatus of the invention generally designated by reference numeral 10. In its preferred form, adjustable construction support apparatus 10 includes a footing assembly 12. A height adjustment assembly is connected to the footing assembly 12, and a bracket assembly 24 attached to height adjustment assembly. The bracket assembly 24 adapted to engage a portion of a structure 26. The height adjustment assembly includes a tube assembly 14 retained in the footing assembly 12, a threaded collar 16 attached to a top portion of the tube assembly 14, and a tube assembly 14 retained in the footing assembly 12. A threaded collar 16 is attached to a top portion of the tube assembly 14. A threaded shaft 18 has complimentary threads to the threaded collar 16, and the threaded shaft 18 is received by the threaded collar 16 such that a lower portion of the threaded shaft 18 extends into the tube assembly 14. A torque-receiving member 20, e.g. a nut 20, is attached to the threaded shaft 18 and is adapted for receiving an applied torque for rotating the threaded shaft 18. The torque may be applied by using a wrench that engages the nut 20. A swivel assembly 22 is connected to an upper portion of the threaded shaft 18, and a bracket assembly 24 is attached to the swivel assembly 22. The bracket assembly 24 is adapted to engage a portion of a structure 26.

Figure 3:
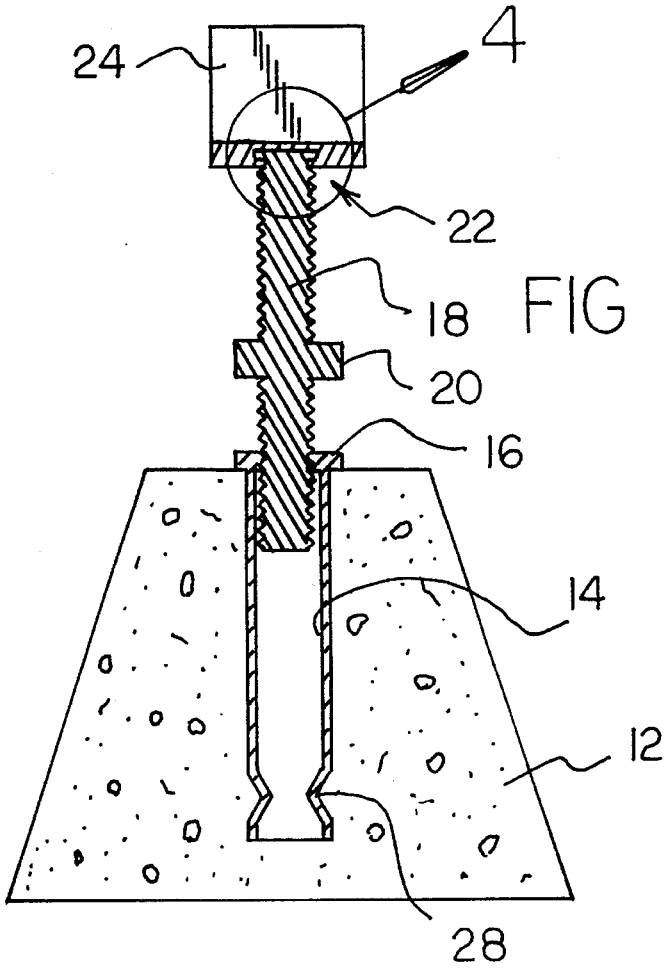
FIG. 3 a cross-sectional view of the embodiment of the adjustable construction support apparatus of FIG. 2 taken along line 3—3 thereof.
Figure 4:
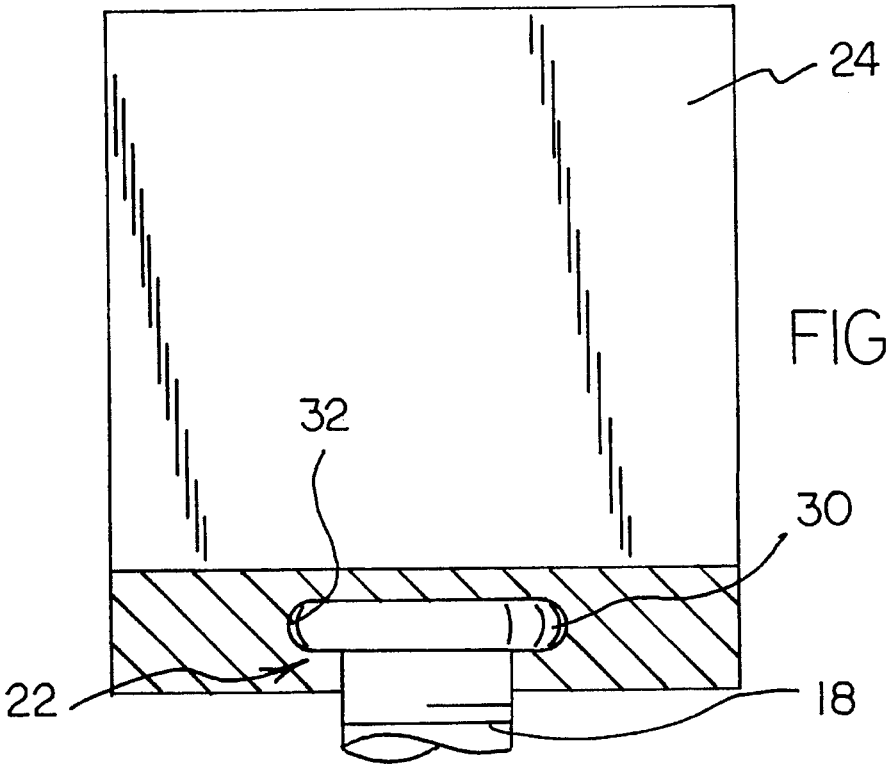
FIG. 4 is an enlarged view of the swivel portion of the embodiment of the invention shown in FIG. 3 contained within the circled region 4 in FIG. 3.

The tube assembly 14 includes a disparate diameter region 28 adapted to receive a portion of the footing assembly 12 such that the tube assembly 14 is secured in the footing assembly 12. That is, the disparate diameter region 28 of the tube assembly 14 is either greater in diameter than the internal diameter of the threaded collar 16 or lesser in diameter than the diameter of the threaded shaft 18. In this respect, the disparate diameter region 28 can be a pinched-in region of the tube assembly 14 as shown in FIG. 3. With this embodiment, a portion of the footing assembly 12 engages the pinched-in portion of the tube assembly 14.

Alternatively, the disparate diameter region 28 can be a flared out region of the tube assembly 14. In addition, the disparate diameter region 28 can be a protuberance sticking out from the tube assembly 14. When the disparate diameter region 28 includes a flared out portion, the flared out portion projects into the footing assembly 12.

The swivel assembly 22 includes a circular flange 30 attached to the threaded shaft 18 and includes a circular groove 32 in the bracket assembly 24. The circular groove 32 receives the circular flange 30 permitting a swivel action between the circular groove 32 on the bracket 24 and the circular flange 30 on the threaded shaft 18 as the threaded shaft 18 is rotated. The bracket assembly 24 includes a U-shaped portion adapted to engage a complementary portion on the structure 26.

The footing assembly 12 can be comprised of concrete. The torque-receiving member 20 is a nut welded onto the threaded shaft 18. The threaded collar 16 is welded onto the tube assembly 14. The threaded collar 16 and the tube assembly 14 can be made as a unified, integrated structure.

In use, a footing assembly 12 is made of poured concrete, and the tube assembly 14, which includes the disparate diameter region 28, is placed in the footing assembly 12 before the concrete solidifies. After solidification, the tube assembly 14 is securely retained in the footing assembly 12 and is prevented from moving vertically, either up or down, in the footing assembly 12 by the engagement of solidified concrete with the disparate diameter region 28 of the tube assembly 14 as well as engagement of solidified concrete with other portions of the tube assembly 14 which contact the solidified concrete.

The lower portion of the threaded shaft 18 is screwed into the threaded collar 16 in a first direction of rotation so that a substantial portion of the threaded shaft 18 extends down into the tube assembly 14. The nut 20 is then turned in the opposite direction so as to elevate the upper portion of the threaded shaft 18 and the bracket assembly 24. When the nut 20 is turned sufficiently, the bracket assembly 24 contacts a bottom portion of the structure 26. When the nut 20 is turned further, the bracket assembly 24 is elevated still further and tightly engages the structure 26, whereby the adjustable construction support apparatus 10 of the invention serves to provide support for the structure 26. As the bracket assembly 24 is engagement with the structure 26 and as the nut 20 is turned, in either direction, the swivel assembly 22 is in operation, that is, the circular flange 30 swivels in the circular groove 32.

Figure 6:
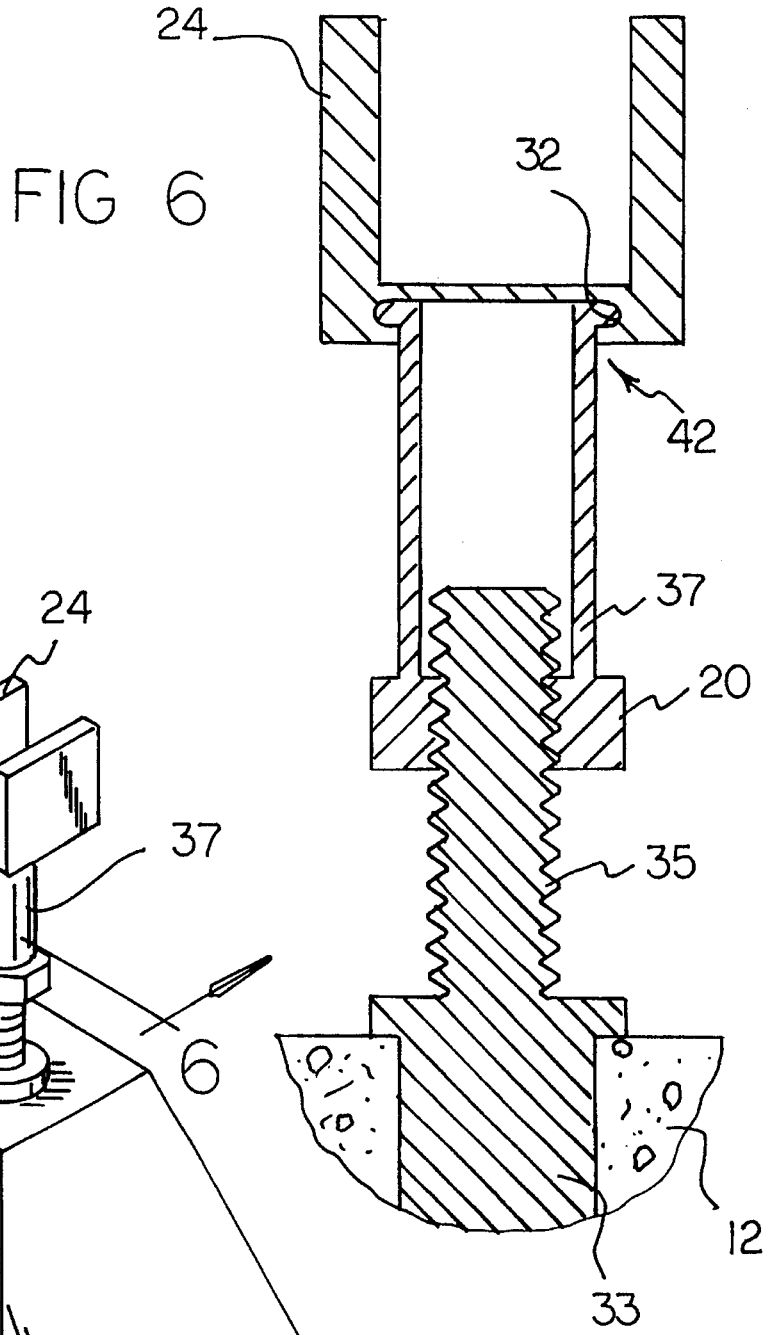
FIG. 6 is an enlarged cross-sectional view of the portion of the embodiment shown in FIG. 5 taken along line 6—6 in FIG. 5.
Figure 5:
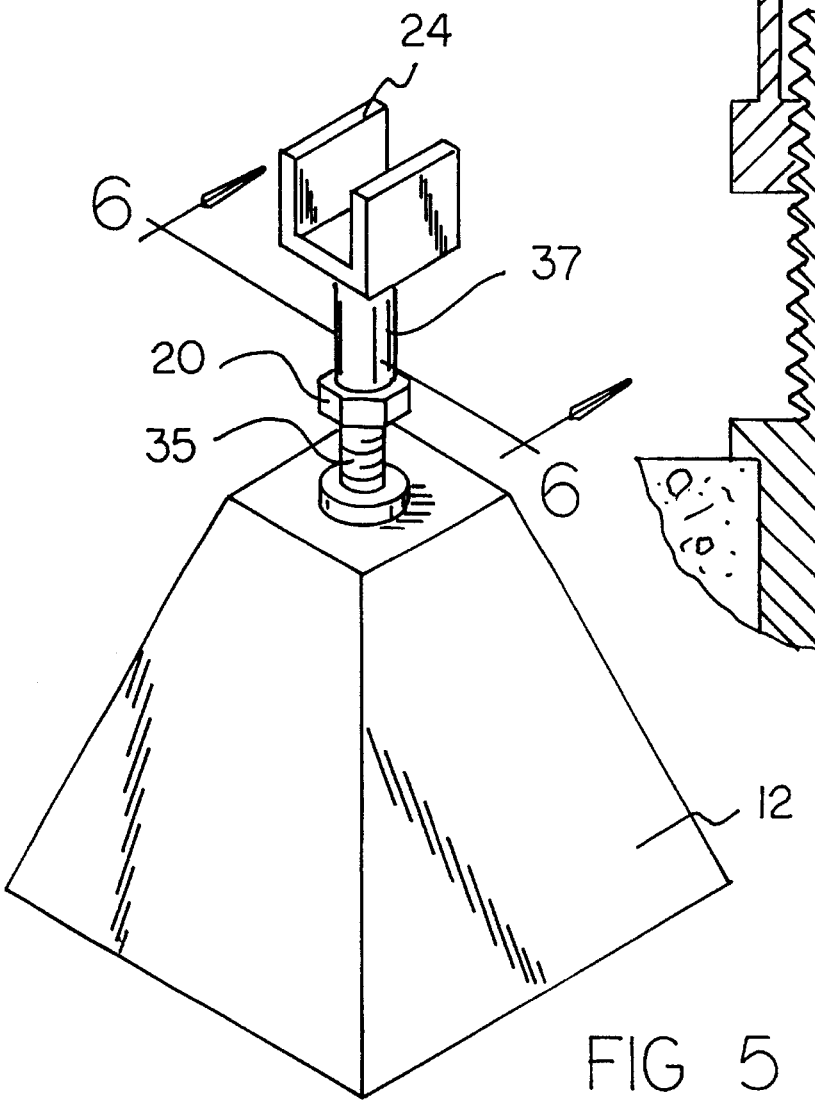
FIG. 5 is a perspective view showing a second preferred embodiment of the adjustable construction support apparatus of the invention.

Turning to FIGS. 5–6, a second embodiment of the invention is disclosed. More specifically, the height adjustment assembly includes a rod portion 33 retained in the footing assembly 12, a threaded shaft 35 attached to a top portion of the rod portion 33. A threaded cylinder 37 has complimentary threads to the threaded shaft 35. The threaded shaft 35 received by the threaded cylinder 37 such that an upper portion of the threaded shaft 35 extends into the threaded cylinder 37. A torque-receiving member 20 attached to the threaded cylinder 37 adapted for receiving an applied torque for rotating the threaded shaft 35. A swivel assembly 42 is connected to an upper portion of the threaded cylinder 37, and a bracket assembly 24 attached to the swivel assembly 42. The bracket assembly 24 adapted to engage a portion of a structure 26.

In use with a structure 26, a plurality of adjustable construction support apparatuses 10 of the invention are placed under the structure 26 at various location. As time goes by and as the structure 26 settles, at various locations under the structure 26, one adjustable construction support apparatus 10 may have to be raised by turning its respective nut 20 in one direction, and another adjustable construction support apparatus 10 of the invention may have to lowered by turning its respective nut 20 in the opposite direction. The nut 20 may be turned by a suitable wrench (not shown).

The components of the adjustable construction support apparatus of the invention can be made from inexpensive and durable metal materials such as steel and concrete.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved adjustable construction support apparatus that is low in cost, relatively simple in design and operation, and which may advantageously be used to enable adjustment of the height of a support for a structure without cutting a support post and without jacking up a structure and employing shims. With the invention, an adjustable construction support apparatus is provided which is usable in conjunction with poured concrete footings. With the invention, an adjustable construction support apparatus is provided which can be readily adjusted by a homeowner. With the invention, an adjustable construction support apparatus is provided which does not use a pivoting support. With the invention, an adjustable construction support apparatus provides for continuously adjustable height. With the invention, an adjustable construction support apparatus is provided which is in position for adjustment and is readily adjustable without requiring installation of additional components. With the invention, an adjustable construction support apparatus is provided which prevents a support from being pulled out of a footing when a reduced height adjustment is made.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

The invention claimed is:

1. An adjustable construction support apparatus, comprising:

a footing assembly, a height adjustment assembly connected to said footing assembly, and a bracket assembly attached to height adjustment assembly, said bracket assembly adapted to engage a portion of a structure, wherein said height adjustment assembly includes:

a rod portion retained in said footing assembly, a threaded shaft attached to a top portion of said rod portion, a threaded cylinder having complimentary threads to said threaded shaft, said threaded shaft received by said threaded cylinder such that an upper portion of said threaded shaft extends into said threaded cylinder, a torque-receiving member attached to said threaded cylinder adapted for receiving an applied torque for rotating said threaded shaft, and a swivel assembly connected to an upper portion of said threaded cylinder wherein said bracket assembly is attached to said swivel assembly.

2. The apparatus of claim 1 wherein said bracket assembly includes a U-shaped portion adapted to engage a complementary portion on the structure.

3. An adjustable construction support apparatus for placement between a footing assembly and a structure, comprising:

a height adjustment assembly adapted for connection to the footing assembly, and a bracket assembly attached to said height adjustment assembly, said bracket assembly adapted to engage a portion of the structure, wherein said height adjustment assembly includes:

a rod portion adapted for retention in the footing assembly, a threaded shaft attached to a top portion of said rod portion, a threaded cylinder having complimentary threads to said threaded shaft, said threaded shaft received by said threaded cylinder such that an upper portion of said threaded shaft extends into said threaded cylinder, a torque-receiving member attached to said threaded cylinder adapted for receiving an applied torque for rotating said threaded shaft, and a swivel assembly connected to an upper portion of said threaded cylinder, wherein said bracket assembly is attached to said swivel assembly.

* * * * *